US007681945B1

(12) United States Patent
Wiecek et al.

(10) Patent No.: US 7,681,945 B1
(45) Date of Patent: Mar. 23, 2010

(54) WALL-AVOIDING CONVERTIBLE OTTOMAN

(75) Inventors: Glenn N. Wiecek, Shelbyville, KY (US); Gary Masters, Shelbyville, KY (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 12/244,362

(22) Filed: Oct. 2, 2008

(51) Int. Cl.
*A47C 16/00* (2006.01)

(52) U.S. Cl. ..... 297/118; 297/378.1; 297/423.41; 297/342

(58) Field of Classification Search ..... 297/130, 297/423.41, 118, 378.1, 342, 341, 378.14, 297/378.12
See application file for complete search history.

(56) References Cited

U.S. PATENT DOCUMENTS 2,655,203 A * 10/1953 Wegner ..... 297/105
2,693,846 A * 11/1954 Luttio ..... 297/105
2,705,994 A * 4/1955 Stattler ..... 297/105
3,004,792 A * 10/1961 Bell ..... 297/118
5,094,505 A * 3/1992 Nichols ..... 297/118
5,098,153 A * 3/1992 Antoine ..... 297/17
5,597,199 A * 1/1997 Hoffman et al. ..... 297/144
6,174,026 B1 * 1/2001 Wise ..... 297/120
7,207,624 B2 * 4/2007 Hoffman et al. ..... 297/125
7,309,101 B2 * 12/2007 True ..... 297/118
2005/0023869 A1 * 2/2005 Longnecker ..... 297/125

* cited by examiner

*Primary Examiner*—Milton Nelson, Jr.
(74) *Attorney, Agent, or Firm*—Shook, Hardy & Bacon LLP

(57) ABSTRACT

This invention is related to an ottoman convertible to a seating unit comprising a back-support assembly, a seat-support assembly, a base frame, and a pair of opposed armrests. Additionally, the ottoman includes a linkage system comprising a plurality of pivotably interconnected linkages, where the linkage system is configured to rotatably couple the seat-support assembly to the back-support assembly, and translatably couple the seat-support assembly and the base frame. In operation, this furniture piece is moveable between a closed position, resembling an ottoman, and an open position, wherein the back-support assembly forms the backrest of a seating unit accessible to a seated occupant. Specifically, the pivotably interconnected linkages operate such that rearward rotational movement of the back-support assembly induces forward translation of the seat-support assembly in relation to the base frame. This movement coincidentally induces the pair of opposed armrests to raise.

17 Claims, 5 Drawing Sheets

WALL-AVOIDING CONVERTIBLE OTTOMAN

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to an upholstered ottoman that converts to a seating unit, such as a recliner chair or sofa, or any other upholstery furniture designed to support a user's body in an essentially seated position. More particularly, an improved linkage system for concurrently controlling pivotable movement of a back-support assembly and slidable adjustment of a seat-support assembly is disclosed.

Ottomans are common in the furniture industry. Typically, ottomans accompany a seating unit as a separate piece of furniture, and more specifically, are placed forward of a traditional seating unit. Further, ottomans are usually configured with an upper surface that is generally planar and/or upholstered such that an occupant seated in the seating unit may rest their feet thereon. As used hereinabove, "seating unit" generally refers to recliners, incliners, sofas, love seats, sectionals, theater seating, traditional chairs, chairs with a moveable seat portion (e.g., motion upholstery furniture), or other such furniture pieces.

The use of ottomans as seating units is prevalent, particularly when the ottoman is portable, which allows it to be moved to various areas of a living space. However, an occupant seated on an ottoman may experience discomfort as it lacks a backrest that is provided with a traditional seating unit. Accordingly, a separate traditional seating unit is desirable, although inconvenient, for use along with an ottoman to properly support a seated occupant.

The present invention pertains to an ottoman that is convertible to a seating unit having a backrest. Significantly, the design of a linkage system within the ottoman is adapted to control an adjustment of armrests and a seat-support assembly concurrently with the articulate movement of a back-support assembly. Further, the present invention provides a wall-proximity feature such that the assemblies mentioned above move in relation to a stationary base frame to avoid contacting a wall that may be rearward of the convertible ottoman.

BRIEF SUMMARY OF THE INVENTION

A brief overview of the convertible ottoman and its components follows immediately below. A more detailed description is provided in the Detailed Description of the Invention section.

The present invention provides a ottoman that converts to a seating unit (hereinafter the "seating unit"). The seating unit broadly includes, a back-support assembly, a pair of opposed armrests, a seat-support assembly, and a base frame. A linkage system is further provided comprising a plurality of pivotably generally interconnected linkages. Further, the linkage system is configured to rotatably couple the seat-support assembly to the back-support assembly and to translatably couple the seat-support assembly and the base frame. Still further, the linkage assembly couples the armrests to both the seat-support assembly and the base frame.

Typically, the seating unit is moveable into different positions, as facilitated by the linkage system. In one embodiment, these positions correspond with movement of the seating unit between the following: a closed position forming an ottoman and an open position forming a seating furniture piece. Accordingly, the back-support assembly is moveable between a closed position, in which the underside of the back-support assembly substantially overlies the seat-support assembly and faces generally downwardly, and an open position, in which the back-support assembly is oriented substantially upright in relation to the seat-support assembly and the underside of the back-support assembly faces generally forwardly. In the open position, the underside of the back-support assembly forms a backrest of a seating unit, and the seat-support assembly forms a seat of a seating unit such that the seating unit is accessible for a seated occupant.

In operation, a user-exerted force upward on the back-support frames creates rearward rotational movement thereof, which in turn, induces rearward rotational movement of the at least one armrest in relation to the seat-support assembly. Coincidentally, the rearward rotational movement induces the seat-support assembly to be translated forward of the base frame and a portion of the back-support assembly to be disposed rearwardly of the seat-support assembly. Forward translation is typically carried out by slide mechanisms that comprise one or more slots located on the base frame that slidably engage with one or more pin-shaped elements extending from the seat-support assembly. Accordingly, translational movement of the seat-support assembly between the closed position and the open position is in substantially parallel-spaced relation to the base frame.

As will be seen from the detailed description that follows, the invention provides a convertible ottoman to a seating unit that provides a wall-proximity feature. Additional advantage, and novel features of the invention will be set forth in part in a description which follows and in part will become apparent to those skilled in the art upon examination of the following, or may be learned by practice of the invention.

BRIEF DESCRIPTION OF THE SEVERAL VIEWS OF THE DRAWING

In the accompanying drawings, which form a part of the specification, and which are to be read in conjunction therewith, and in which like reference numerals are used to indicate like parts in the various views, where thicknesses and dimensions of some components may be exaggerated for clarity.

DETAILED DESCRIPTION OF THE INVENTION

Figure 1:
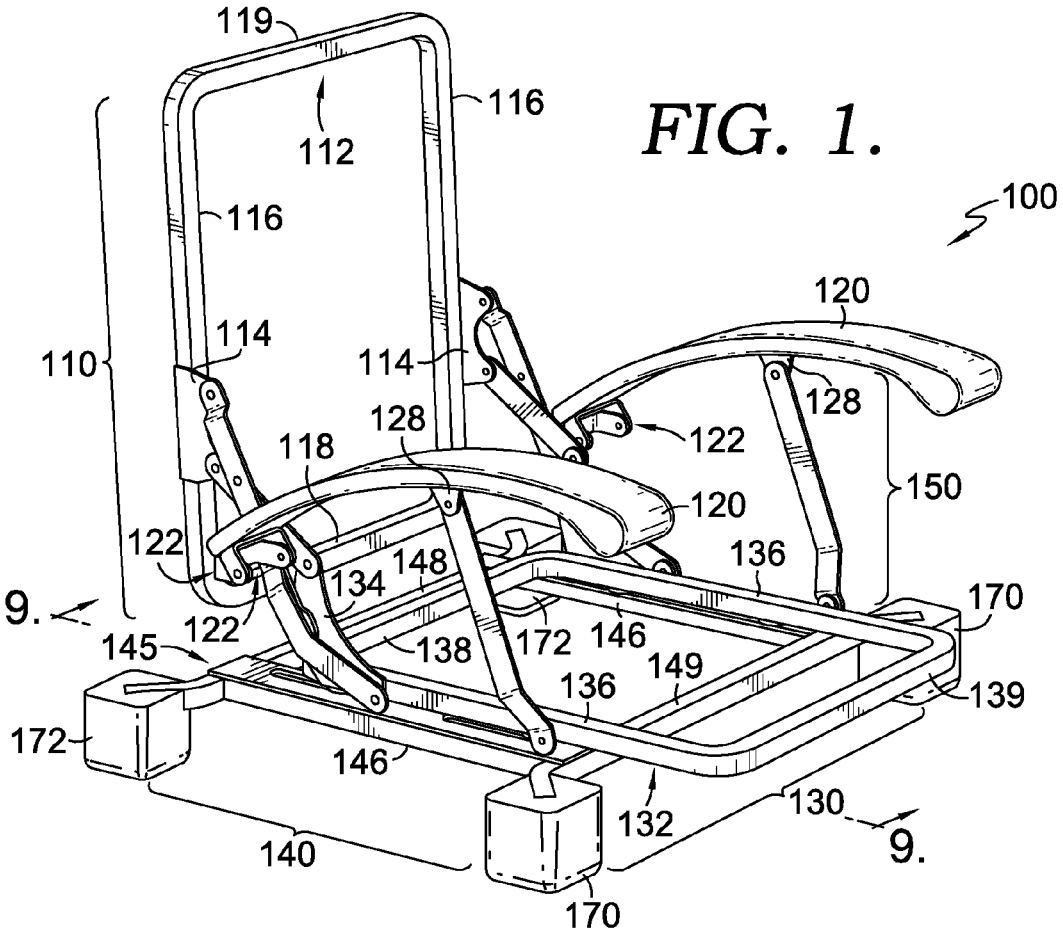
FIG. 1 is a diagrammatic perspective view of a seating unit, adjusted to the open position, according to an embodiment of the present invention.

Referring to the drawings in greater detail and initially to FIG. 1, the embodiments of the present invention are directed toward an ottoman convertible to a seating unit (hereinafter the "seating unit"), which is shown and designated generally by reference numeral 100. The seating unit 100 broadly includes, a back-support assembly 110, a pair of opposed armrests 120, a seat-support assembly 130, a base frame 140, and a linkage system 150. Typically, the seating unit is moveable into different positions, as facilitated by the linkage system 150, more fully discussed below in FIG. 2. In one embodiment, these positions correspond with movement of the seating unit between the following: a closed position forming an ottoman; and an open position forming a furniture piece having a seat back. A diagrammatic perspective view of the seating unit 100 adjusted to the open position, according to one embodiment of the present invention, is shown in FIG. 1.

The components mentioned above will now be discussed with more detail, with reference to FIG. 1. The back-support assembly 110 includes an upper tube assembly 112, and a pair of opposed seatback brackets 114 that extend therefrom. The upper tube assembly 112 is typically constructed from a generally rigid material, such as square steel tubing or square stock, and generally forms a rectangularly-shaped profile. In one embodiment, the upper tube assembly 112 includes a pair of laterally-spaced side members 116, a first crossbeam 118, and a second crossbeam 119. The pair of opposed seatback brackets 114 are typically mounted on each of the respective laterally-spaced side members 116, and extend in a substantially perpendicular direction therefrom. In the embodiment depicted on FIG. 1, the pair of opposed seatback brackets 114 are mounted on a mid portion of the pair of laterally-spaced side members 116 between the first crossbeam 118, and the second crossbeam 119. The mounting may comprise a welded joint, connection by suitable fasteners, or any other method know to those of ordinary skill in the art.

Additionally, the pair of opposed seatback brackets 114 may be formed from metal bar stock, stamped or formed steel, laser-cut from sheet metal, or any other sturdy material, any of which would be suitable for use with the present invention. Moreover, the seating unit 100 illustrated and described herein comprises a plurality of linkages and brackets, as discussed throughout. These linkages and brackets may be formed, as discussed in conjunction with the pair of opposed seatback brackets 114, from any suitable material known to those of ordinary skill in the furniture-manufacturing industry. Thus, although the attributes of each subsequently mentioned linkage and/or bracket will not be discussed, it should be understood that the material selections and variety of fabrication procedures above is to be applied to each.

Figure 5:
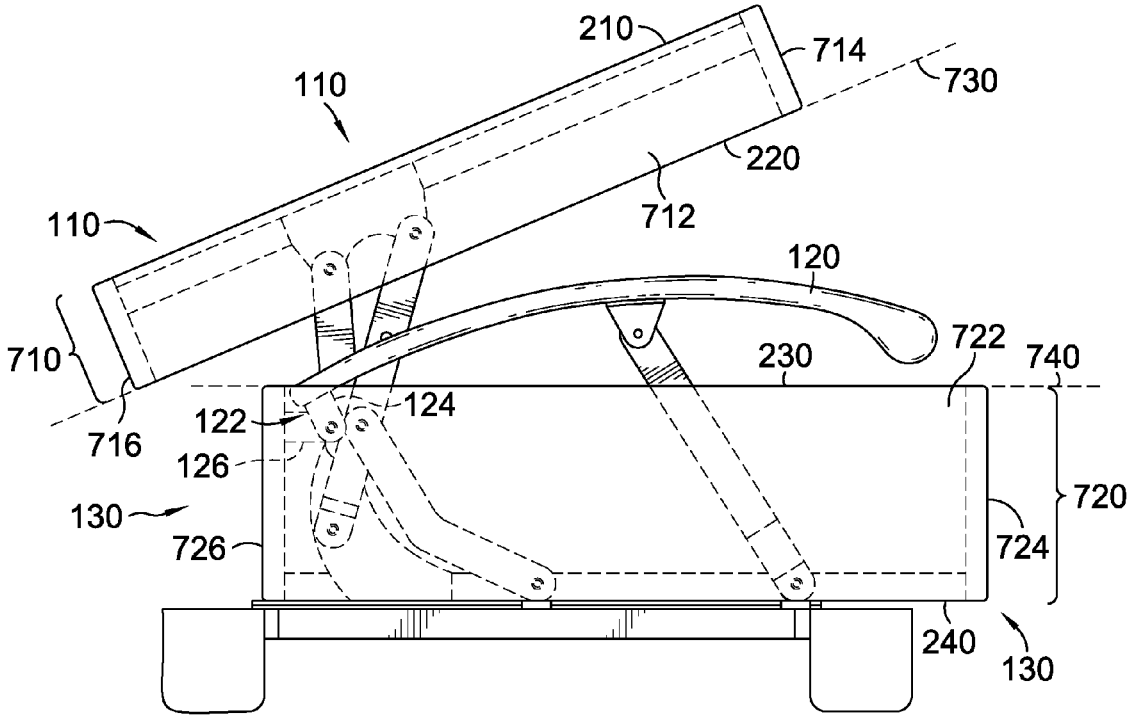
FIG. 5 is a side perspective view of the seating unit with a top frame and bottom frame assembled thereto, adjusted to a transitional orientation between the open and closed positions, in accordance with embodiments of the present invention.

The pair of opposed armrests 120 each include an arm-pivot bracket 122 and an intermediate bracket 128. The arm-pivot bracket 122 is located on the rearward portion of each of the pair of armrests 120 enabling rotation by pivotably coupling the armrests 120 to the seat-support assembly 130. Turning briefly to FIG. 5, the pivotable coupling to the seat support assembly 130 is shown in detail. As illustrated, a rearward panel 726 of a bottom frame 720 attached to the seat-support assembly 130 carries the arm-pivot bracket 122. In one embodiment, as shown in FIG. 5, the arm-pivot bracket includes at least an external C-shaped element 124 that connects to a respective armrest 120, and an internal C-shaped element 126 that connects to the seat-support assembly 130. In this configuration, the pivotable coupling is embodied as a pin (e.g., clevis pin) or pair of pins that align the C-shaped elements 124, 126, and provide an axis for rotational movement of the armrests 120. Returning to FIG. 1, the intermediate bracket 128 is located on a mid portion of each respective armrest 120 and pivotably couples the linkage system 150 thereto. It should be appreciated and understood that although a pair of armrests 120 is depicted and described, persons familiar with the field of invention would realize that the present invention is not limited to two armrests and that one or multiple armrests may be used according to the design of the convertible furniture piece.

Figure 2:
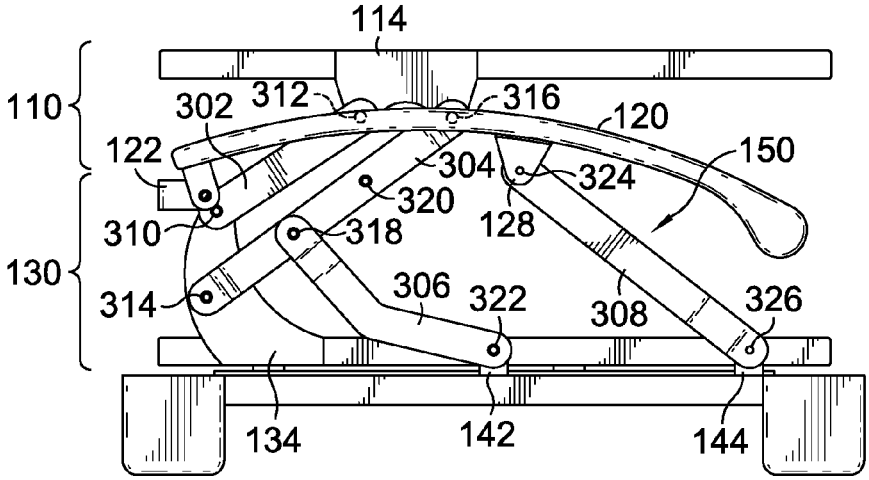
FIG. 2 is a side perspective view of the seating unit, adjusted to the closed position, in accordance with an embodiment of the present invention.

The seat-support assembly 130 includes a bottom frame 132, and a pair of opposed boomerang-shaped plates 134 that extend upward therefrom (seen in additional detail in FIG. 2). The lower tube assembly 132 is typically constructed from a generally rigid material, such as square steel tubing or square stock, and generally forms a rectangular-shaped profile. In one embodiment, the lower tube assembly 132 includes a pair of laterally-spaced side members 136, a first crossbeam 138, and a second crossbeam 139. The pair of opposed boomerang-shaped plates 134 are typically mounted on each of the respective laterally-spaced side members 136, and extend in a substantially perpendicular direction therefrom. In the embodiment depicted on FIG. 1, the pair of opposed boomerang-shaped plates 134 are mounted on a rear portion of the pair of laterally-spaced side members 136 just forward of the first crossbeam 138. The mounting may comprise a welded joint, connection by suitable fasteners, or any other method know to those of ordinary skill in the art. In one instance, the profile of the boomerang-shaped plates 134 includes a forward concave edge formed with a steeply downward slope that accommodates cushions to support a seated occupant, as discussed more fully below.

Figure 6:
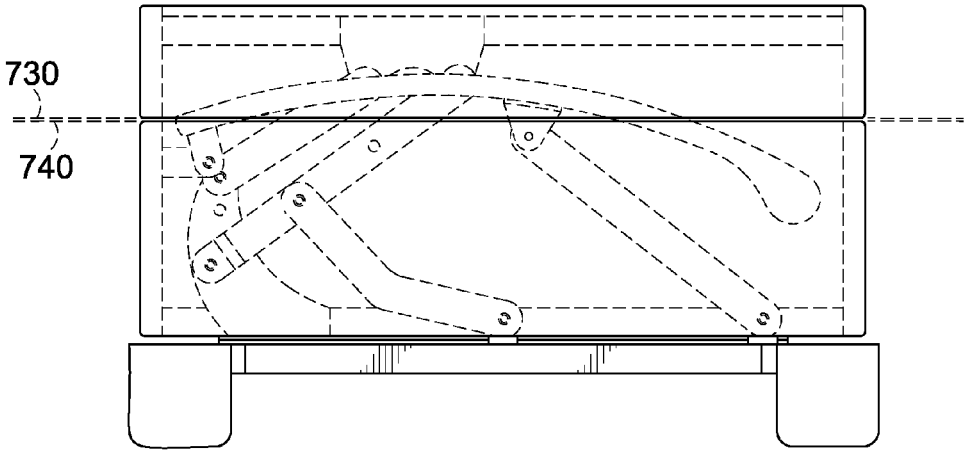
FIG. 6 is a view similar to FIG. 5, but with the seating unit adjusted to the closed position, according to an embodiment of the present invention.

In an exemplary embodiment, the seat-support assembly 130 includes a bottom frame 720 while the back-support assembly 110 includes a top frame 710, as generally shown in FIGS. 5 and 6. Top frame 710 includes a forward panel 714, a rearward panel 716, and a pair of side panels 712 extending between the forward panel 714 and the rearward panel 716. Bottom frame 720 includes a forward panel 724, the rearward panel 726, and a pair of side panels 722 extending between the forward panel 724 and the rearward panel 726. The panels 712, 714, 716, 722, 724, and 726 are typically formed of sturdy material. Further, bottom edges of panels 712, 714, and 716 form a bottom perimeter that defines a lower planar surface 730 of the back-support assembly 110. Top edges of panels 722, 724, and 726 form an upper perimeter that defines an upper planar surface 740 of the seat-support assembly 730. Further consideration of these planar surfaces 730, 740, will be given below in a discussion regarding operation of the seating unit 100.

Figure 7:
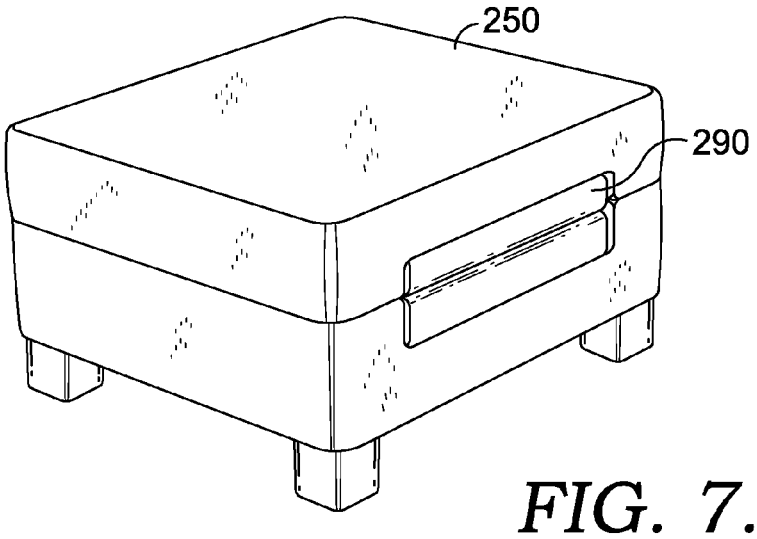
FIG. 7 is diagrammatic view of the seating unit with an upholstered exterior, adjusted to the closed position, in accordance with an embodiment of the present invention.
Figure 8:
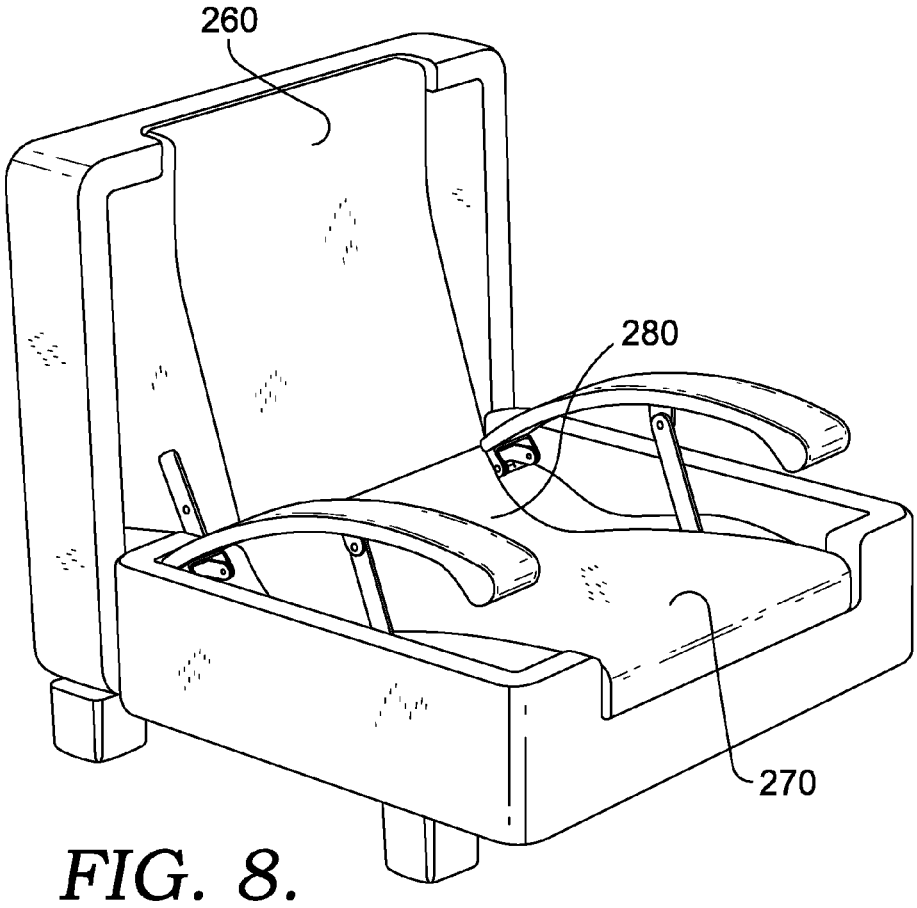
FIG. 8 is a view similar to FIG. 7, but with the seating unit adjusted to the open position, in accordance with an embodiment of the present invention.

In embodiments, cushions, upholstery, or any other fabric and foam combination is assembled to the exterior of the top frame 710 and bottom frame 720 of the seating unit 100. With continued reference to FIG. 5, the back-support assembly 110 includes an upper side 210 and an underside 220. Additionally, the seat-support assembly includes an upper side 230 and an underside 240. The upper side 210 may include a rigid support (not shown), such as a board or spring frame, to provide structural integrity to a top cushion 250 (FIG. 7) disposed above the top frame 710 and between the armrests 120. The top cushion 250 typically forms a generally planar surface that serves as footrest or a padded, stool-type, seating area for the user when the seating unit 100 is adjusted to an ottoman, in the closed position. In the open position, the underside 220 of the back-support assembly 110 forms the backrest of the seating unit 100, and the seat-support assembly 130 forms the seat. Typically, a backrest cushion 260 (FIG. 8) or other upholstery is disposed along the underside 220 of the back-support assembly 110 to provide the seated occupant a comfortable padded back support. Also a seat cushion 270 (FIG. 8) or other upholstery is disposed along the upper side 230 of the seat-support assembly 130 so that the seating unit 100 is comfortable to a seated occupant. In one embodiment, a rigid support element (not shown), such as a board or spring frame, provides structure or rigidity for the seat cushion 270. Optionally, a raised lip 280 (FIG. 8) on the seat cushion 270 is depicted to provide lumbar support for an occupant's lower back.

Figure 4:
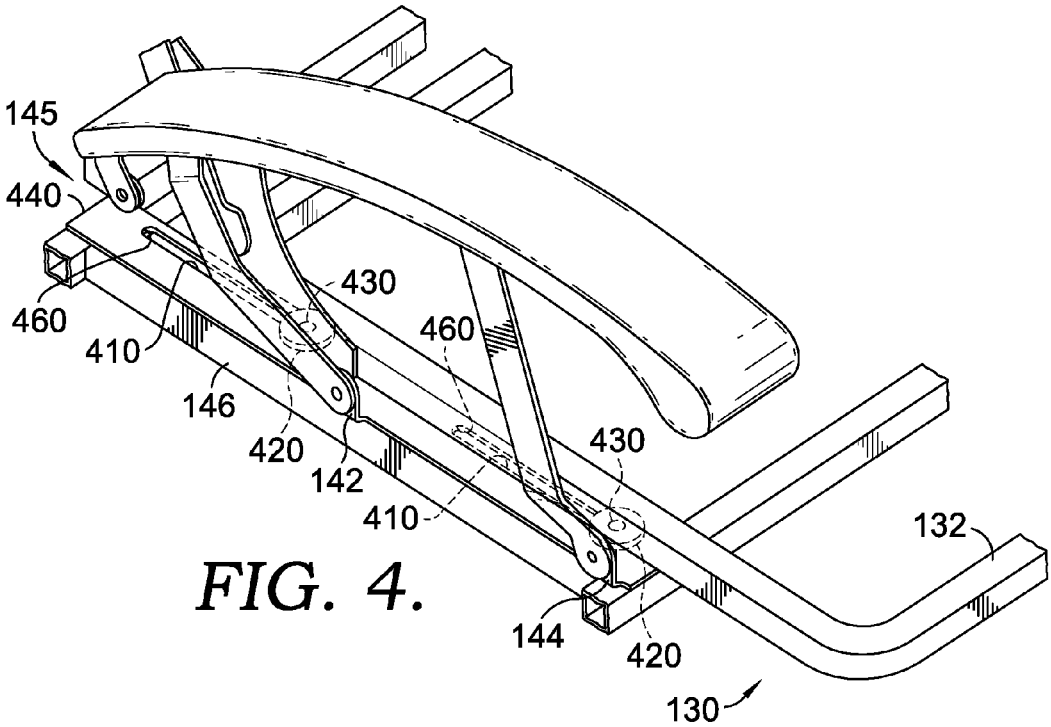
FIG. 4 is an enlarged partial diagrammatic view featuring a slide mechanism in the open position, in accordance with an embodiment of the present invention.
Figure 9:
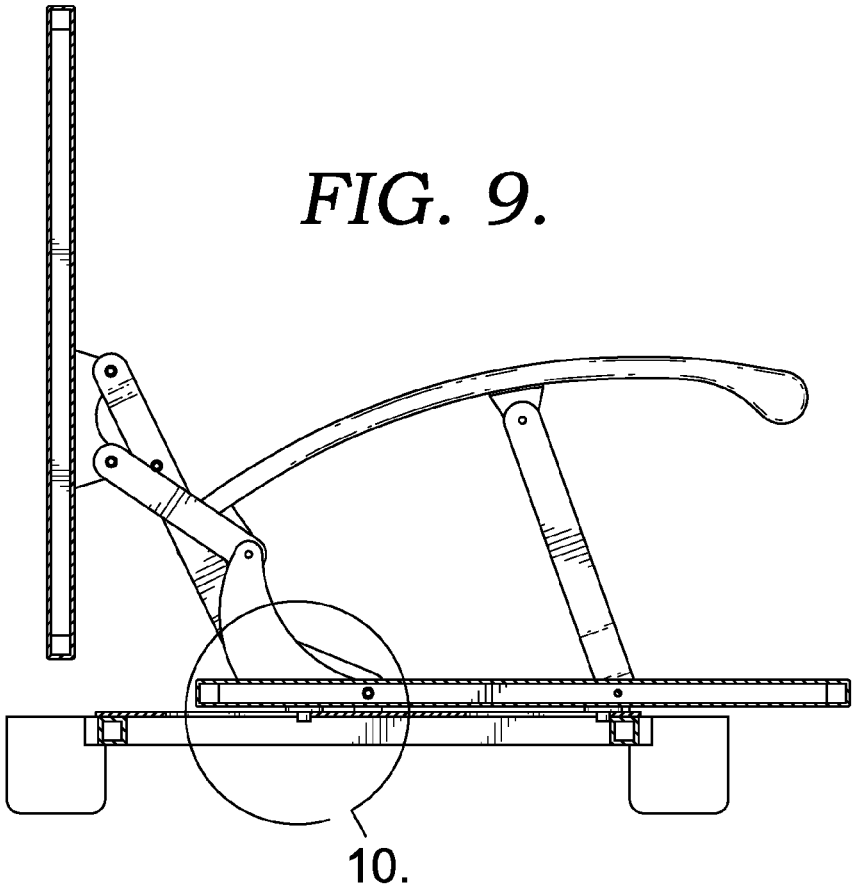
FIG. 9 is a side cross-section view of the seating unit, adjusted to the open position, according to an embodiment of the present invention.
Figure 10:
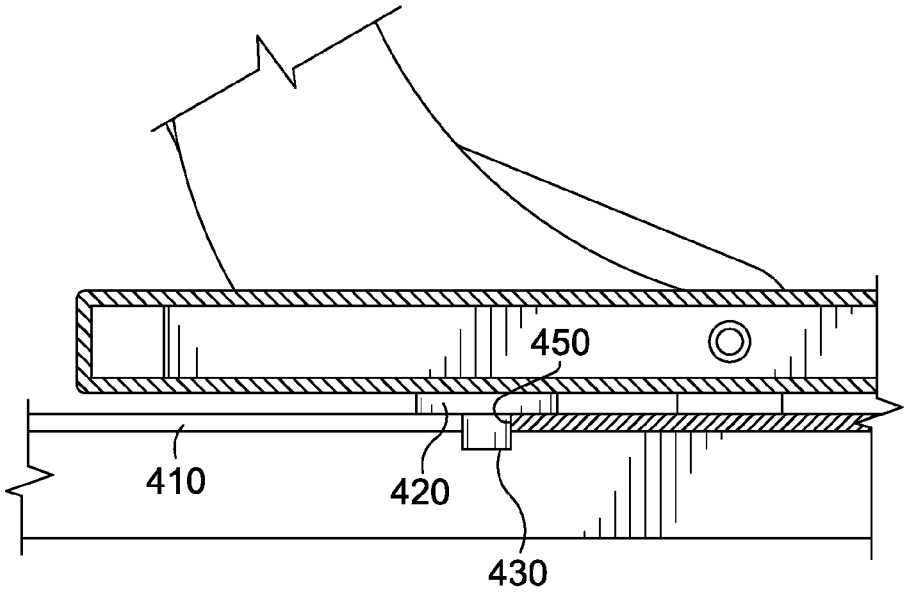
FIG. 10 is an enlarged partial side cross-section view of the slide mechanism, the seating unit adjusted to the open position according to an embodiment of the present invention.

The base frame 140 serves as an anchor to the seating unit 100, as it maintains a stable position throughout the opening and closing operation of the various seating unit components. Referring back to FIG. 1, base frame 140 broadly includes a pair of substantially parallel-spaced lateral support members 146, a forward transverse member 149, a rearward transverse member 148, and a pair of slide mechanisms 145. Slide mechanisms 145 typically reside on each of the lateral support members 146 and are discussed in greater detail immediately below with reference to FIGS. 4, 9, and 10. The lateral support members 146 and the transverse members 148, 149, are typically constructed from a generally rigid material, such as square steel tubing or square stock, and generally form a rectangular-shaped profile. Each of the pair of lateral support members 146 includes a backrest bracket 142 and an armrest bracket 144, as best depicted in FIG. 4. Backrest brackets 142 (FIG. 2) are positioned toward a central area of each lateral support member 146 and extend upwardly therefrom. Additionally, backrest brackets 142 (FIG. 2) serve to capture a pivot that allows the back-support assembly 110 to angularly rotate. Armrest brackets 144 are positioned near the forward transverse member 149 at a forward portion of each lateral support member 146 and extend upwardly therefrom. Additionally, armrest brackets 144 serve to capture a pivot that allows the pair of opposed armrests 120 to rise and lower in relation to the base frame 140. Alternatively, the brackets 144, 142, may be formed as tabs that were originally machined as a feature of each of the lateral support members 146.

Returning to FIG. 1, the slide mechanisms 145 enable slidable engagement of the seat-support assembly 130, near the underside 240 (FIG. 5), and the lateral support members 146 of the base frame 140. Slidable engagement facilitates forward and rearward translation of the seat-support assembly 130, i.e., traversing the base frame 140, when opening and closing the seating unit 100.

Referring now to FIG. 4, each of the slide mechanisms 145 include one or more slots 410, one or more bushings 420, and one or more pin-shaped elements 430 extending generally downward from the seat-support assembly 130. Slots 410 include an opening having a front end 450 (FIG. 10), and a back end 460, where the ends 450, 460 may be rounded to receive a pin-shaped element. As more fully discussed below, the front end 450 assists is resisting adjustment of the seating unit 100 beyond the open position. Also, slots 410 may be formed into the lateral support members 146, or into a separate plate 440 that is mated onto the lateral support members 146. Bushings 420 are attached on the underside 240 (FIG. 5) of the seat-support assembly 130, and more particularly, to the bottom frame 132. Bushings 420 function as spacers to reduce friction during slidable engagement, and may be polished or oiled to facilitate effortless translation of the seat-support assembly 130 over the base frame 140. Typically, the pin-shaped element 430 is mounted generally downward from the bottom frame 132 and axially aligned with a central bore of the each respective bushing 420. Pin-shaped element 430 is sized and shaped to fit within the opening of each respective slot 410 but not interfere with other linkages or contact the underlying surface. Further, the pin-shaped element 430 may be formed of steel rod, rolled metal, or any other rigid material known or used by those with ordinary skill in the field of furniture manufacturing. In an exemplary embodiment, the slot 410, the bushing 420, and the pin-shaped element 430 are provided and assembled in a one-to-one ratio. Although two of these assemblies are illustrated per slide mechanism 145, one of ordinary skill will appreciate that one or multiple assemblies may be provided on the seating unit 100.

With reference to FIG. 1, in one embodiment of the base frame 140, the rearward transverse member 148 and forward transverse member 149 extend laterally beyond the lateral support members 146 and serve as rigid connections to rear legs 172 and front legs 170. It should be understood that the designation of reference numerals 170 and 172 as "legs" is not meant to be limiting, wherein the legs 170, 172, may be blocks, risers, a frame, or any other element(s) that vertically support the base frame 140 above an underlying surface (not shown). Further, legs 170, 172, may be formed of a solid metal rod, square bar, shaped wood, or any other suitable material known to those of ordinary skill in the furniture-manufacturing industry. Optionally, a lower portion of the legs, 170, 172, may include castors that allow the seating unit 100 to travel over, roll along, the underlying surface. Although, a pair of front legs 170, and a pair of rear legs 172 is described and illustrated in FIG. 1, any number of legs, including no legs, is contemplated by the present invention.

Turning now to FIG. 2, the linkage system 150 will now be discussed in detail. Initially, linkage system 150 comprises a plurality of linkages that are arranged to articulately actuate and control movement of the seating unit during convertible movement between the open and closed positions. These linkages may be pivotably interconnected. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary as desired, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements (such as intervening elements) may also be present.

The linkage system 150 guides the rotational movement of the back-support assembly 110 and the translational movement of the seat-support assembly 130, in relation to the base frame 140. In an exemplary configuration, these movements are controlled by a pair of mirror-image linkage systems (one of which is shown herein), which comprise pivotably interconnected linkages. The linkage systems are mirror-images of each other about a longitudinally-extending plane that bisects the seating unit 100 between the pair of opposed armrests 120. As such, the ensuing discussion will focus on only one of the linkage systems, with the content being equally applied to the other linkage assembly.

Figure 3:
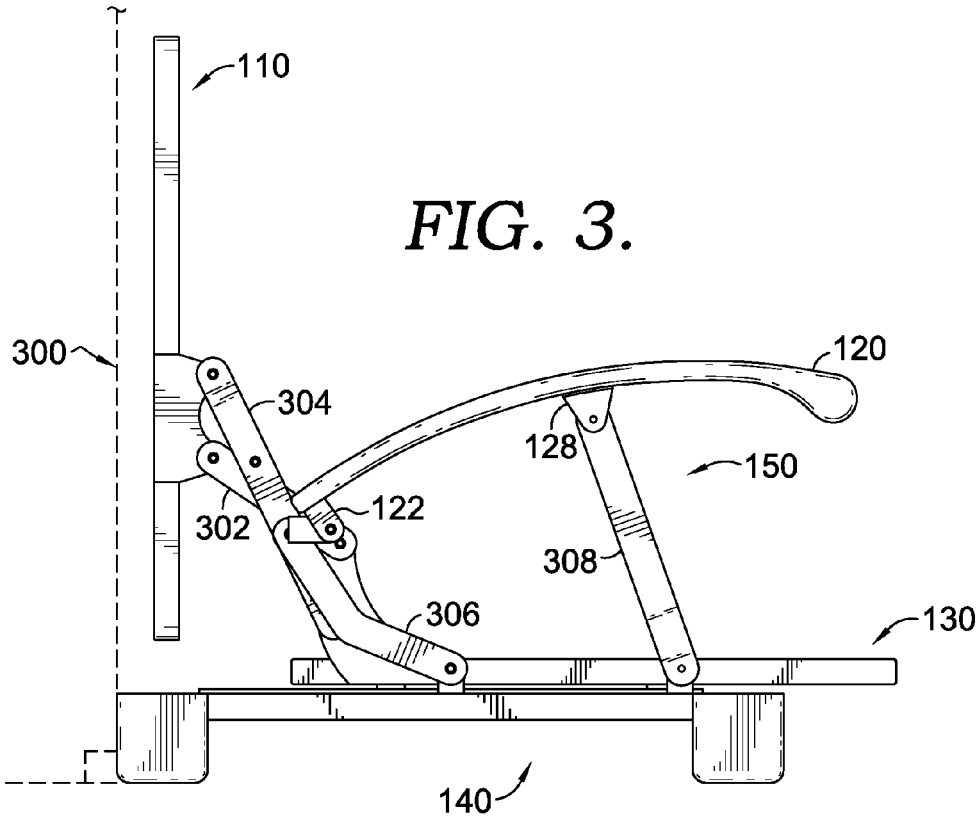
FIG. 3 is a view similar to FIG. 2, but with the seating unit adjusted to the open position, in accordance with an embodiment of the present invention.

With particular reference to FIGS. 2 and 3, the linkage system 150, includes at least a swing linkage 302, a fulcrum linkage 304, a drive linkage 306, and a raise linkage 308. Swing linkage 302 is pivotably coupled on a first end to the back-support assembly 110 at pivot point 312 on a rearward portion of the seatback bracket 114. Swing linkage 302 is also pivotably coupled on a second end to the seat-support assembly 130 at an upper end of boomerang-shaped plate 134 at pivot point 310. Fulcrum linkage 304 is pivotably coupled at pivot point 316 on an upper end to the back-support assembly 110 on a forward portion of the seatback bracket 114. Fulcrum linkage 304 is also pivotably coupled at pivot point 314 on a lower end to the seat-support assembly 130 at a generally central area of the boomerang-shaped plate 134. Optionally, a pin 320 may be located on the fulcrum linkage 304 to interfere with the swing linkage 302 thereby resisting rearward rotation of the back-support assembly 110. Drive linkage 306 is pivotably coupled on a rearward end to a mid portion of the fulcrum linkage 304 at pivot point 318. Drive linkage 306 is also pivotably coupled at pivot point 322 on a forward end to a mid portion of the base frame 140 at the backrest bracket 142. Raise linkage 308 is pivotably coupled on an upper end of the armrest 120 at the intermediate bracket 128 at pivot point 324. Raise linkage 308 is also pivotably coupled at pivot point 326 on a lower end to a forward portion of the base frame 140 at the armrest bracket 144.

Next, the convertible operation of the seating unit will be discussed with continued reference to FIGS. 2 and 3. Initially, the closed position, shown in FIG. 2, will be described. In the closed position, the underside 220 (FIG. 5) of the back-support assembly 110 substantially overlies the seat-support assembly 130 and faces generally downwardly. Additionally, the pivotable coupling of the rearward end the drive linkage 306 is situated rearward of the pivotable coupling of the upper end of the fulcrum linkage 304 such that a downward force created by a seated occupant resists adjustment of the seating unit 100 from the closed position. In the open position, as shown in FIG. 3, the back-support assembly 110 is oriented substantially upright in relation to the seat-support assembly 130 and the underside 220 (FIG. 5) of the back-support assembly 110 faces generally forwardly. Also, the back-support assembly 110 is rearwardly disposed of the seat-support assembly 130. Additionally, the pivotable coupling of the rearward end of the drive linkage 306 is situated forward of the pivotable coupling the upper end of the fulcrum linkage 304 such that a rearward force created by the seated occupant resists adjustment of the seating unit 100 from the open position.

To commence adjustment from the closed position to the open position a user may exert an upward force on a manual-access portion 290 (FIG. 7) of the back-support assembly 110. This force generates several coincidental movements within the linkage system 150. Generally, the upward force causes rearward rotational movement of the back-support assembly 110, rearward rotational movement of the armrests 120, and forward translational movement of the seat-support assembly 130 such that a forward portion overhangs the base frame 140.

More specifically, rearward rotational movement of the back-support assembly 110 describes a generally circuitous path that is guided by its pivotable coupling to the swing link 302 and the fulcrum link 304. These links 302, 304, rotate rearward with back-support assembly 110 governing its angular inclination and rotational position with respect to the seat-support assembly 130. Rearward rotation of the fulcrum link 304 is about pivot point 318 that pivotably couples the fulcrum link 304 to the rearward end of drive link 306. The forward end of the drive link 306 is pivotably coupled to the base frame 140 thereby limiting the lateral movement of the drive link 306. Accordingly, rearward rotation of the fulcrum link 304 creates a counterclockwise torque about pivot point 318 that is transferred to the boomerang-shaped plate 134, attached to the seat-support assembly 130, in a forward lateral direction. This forward-lateral force, that is aligned with the openings of the slots 410, triggers the forward translational movement of the seat support assembly 130. In one embodiment, the forward translational movement of the seat-support assembly 130 is in substantially parallel-spaced relation to the base frame 140. The forward translational movement of the seat-support assembly 130 forces the armrests 120 forward at the arm-pivot bracket 122. This forward motion causes clockwise angular rotation of the raise link 308 about the pivot point 326 that is fixedly connected to the base frame 140. Accordingly, the clockwise angular rotation of the raise link 308 drives the armrest upward at the intermediate bracket 128 such that the armrests are exposed from the seat-support assembly 130.

In an exemplary embodiment, rearward rotational movement of the back-support assembly 110 meets resistance upon the pin 320 contacting the swing linkage 302, the pin-shaped element 430 contacting the front end 450 (FIG. 10) of the slot 410 opening, or both. This resistance may occur when the back-support assembly 110 is at any degree of inclination. Preferably, the degree of inclination at the open position is substantially ninety degrees, i.e., perpendicular to the seat-support assembly 130. In this instance, the back-support assembly 110 is prevented from contacting a surrounding wall, being referred to herein as the wall-proximity feature. In particular, with reference to FIG. 3, a vertically-extending plane 300, being defined by the one or more rear legs 172 and being perpendicular to the underlying surface, represents a nearest possible wall. The wall-proximity feature is configured such that the back-support assembly 110 rests in a position forwardly disposed of, and in substantially parallel-spaced relation to, the vertically-extending plane when in the open position. Although two different configurations of a mechanism to resist rearward rotational movement are discussed, it should be appreciated and understood by those of ordinary skill in the art that other such mechanisms could be used, and the invention is not limited to those discussed herein.

Turning to FIG. 2, to commence adjustment from the open position to the closed position a user may exert a forwardly-directed force on the back-support assembly 110 (in the position shown in FIGS. 1 and 3). This force generates several coincidental movements within the linkage system 150. Generally, the forwardly-directed force causes forward rotational movement of the back-support assembly 110, forward rotational movement of the armrests 120, and rearward translational movement of the seat-support assembly 130 such that the underside 220 (FIG. 5) increasingly overlies the base frame 140.

More specifically, forward rotational movement of the back-support assembly 110 cause the links 302, 304, to rotate forward about the pivotable coupling with the drive link 306. Accordingly, forward rotation of the fulcrum link 304 creates a clockwise torque that is transferred to the seat-support assembly 130, in a rearward lateral direction. This rearward-lateral force, coincidentally rearwardly translates the seat support assembly 130. The rearward translational movement of the seat-support assembly 130 forces the armrests 120 rearward at the arm-pivot bracket 122 and causes counter-clockwise angular rotation of the raise link 308. Accordingly, the counterclockwise angular rotation of the raise link 308 drives the armrest downward into a cavity within the seat-support assembly 130.

Although this transformation procedure is described with reference to manual operation, the present invention contemplates automated assistance (e.g., motor, electric engine, or the like) to create the convertible motion between the open and closed positions.

It should be understood that the construction of the linkage system 150 lends itself to enable the back-support assembly 110 to be easily assembled and disassembled from the remaining components of the seating unit 100. Specifically the nature of the pivot points 312, 316, on the seatback bracket 114, or any other pivot and/or mounting location, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An ottoman convertible to a seating unit, the ottoman comprising:

a base frame having a slide mechanism;

a seat-support assembly being slidably engaged with the base frame at the slide mechanism;

a back-support assembly having an underside;

a linkage system comprising a plurality of pivotably interconnected linkages, the linkage system being configured to rotatably couple the seat-support assembly to the back-support assembly, the linkage system further configured to translatably couple the seat-support assembly and the base frame;

wherein the back-support assembly is moveable between a closed position, in which the underside of the back-support assembly substantially overlies the seat-support assembly and faces generally downwardly, and an open position, in which the back-support assembly is oriented substantially upright in relation to the seat-support assembly and the underside of the back-support assembly faces generally forwardly.

2. The ottoman of claim 1, wherein the seat-support assembly is moveable between the closed position, in which the seat-support assembly substantially overlies the base frame, and the open position, in which a portion of the seat-support assembly is translated forward of the base frame and a portion of the back-support assembly is disposed rearwardly of the seat-support assembly.

3. The ottoman of claim 2, wherein the movement of the seat-support assembly between the closed position and the open position is in substantially parallel-spaced relation to the base frame.

4. The ottoman of claim 1, wherein the slide mechanism comprises a slot located on the base frame that slidably engages with a pin-shaped element extending from the seat-support assembly.

5. The ottoman of claim 4, wherein the slot comprises an opening having a rearward end and a forward end, the forward end contacting the pin-shaped element in the open position, thereby restraining rearward rotational movement of the back-support assembly.

6. The ottoman of claim 1, wherein a front support leg and a rear support leg extend generally downward from the base frame vertically supporting the base frame above an underlying surface.

7. The ottoman of claim 6, wherein the rear support leg defines a vertically-extending plane that is perpendicular to the underlying surface, the back-support assembly being forwardly disposed of, and in substantially parallel-spaced relation to, the vertically-extending plane when in the open position.

8. The ottoman of claim 1, the ottoman comprising at least one armrest, the at least one armrest having a rear portion that is provided with a bracket to facilitate a pivotable coupling with the seat-support assembly, and a mid portion that is provided with a bracket to facilitate a pivotable coupling with the linkage system.

9. The ottoman of claim 8, wherein the linkage system is pivotably interconnected between the back-support assembly, the at least one armrest, and the seat-support assembly such that rearward rotational movement of the back-support assembly induces rearward rotation movement of the at least one armrest in relation to the seat-support assembly.

10. The ottoman of claim 9, wherein in the open position, the underside of the back-support assembly forming a back-rest of a seating unit, and the seat-support assembly forming a seat of a seating unit, the seating unit being accessible for a seated occupant.

11. The ottoman of claim 1, wherein an upper side of the seat-support assembly opposite to the underside is provided with an upholstered top cushion that is configured to form a substantially horizontal surface when in the closed position.

12. A seating unit foldable to an ottoman, the seating unit comprising:

a base frame;

a seat-support assembly being slidably engaged with the base frame;

at least one armrest being pivotably coupled to the seat-support assembly;

a back-support assembly;

a linkage system comprising a plurality of pivotably interconnected linkages;

wherein the linkage system being configured to pivotably interconnect the base frame, the seat-support assembly, and the back-support assembly, such that forward rotational movement of the back-support assembly induces rearward translation of the seat-support assembly in relation to the base frame and coincidentally induces forward rotational movement of the at least one armrest in relation to the seat-support frame.

13. The seating unit of claim 12, wherein the back-support assembly is moveable between an open position, in which the back-support assembly is oriented substantially upright and rearwardly disposed of the seat-support assembly, and a closed position, in which the back-support assembly substantially overlies the seat-support assembly in substantially parallel-spaced relation.

14. The seating unit of claim 12, wherein the slidable engagement is embodied as a slide mechanism that facilitates the rearward translation of the seat-support assembly when traversing the base frame.

15. The seating unit of claim 12, wherein the back-support assembly comprises a top frame having a lower perimeter defining a lower planar surface and the seat-support assembly comprises a bottom frame having an upper perimeter defining an upper planar surface, the lower planar surface substantially aligning with the upper planar surface when in the closed position.

16. The seating unit of claim 15, wherein contact between a portion of the lower perimeter of the back-support assembly top frame and a portion of the upper perimeter of the seat-support assembly bottom frame restraining forward rotational movement of the back-support assembly.

17. The seating unit of claim 15, wherein in the closed position, an upper side of the back-support assembly opposite to the lower planar surface forming a footrest surface of an ottoman.

* * * * *